US005448464A

United States Patent [19]

Moss

[11] Patent Number: 5,448,464

[45] Date of Patent: Sep. 5, 1995

[54] LAMP STANDS

[75] Inventor: Peter E. Moss, Halesowen, United Kingdom

[73] Assignee: Ellis Moss Patents Limited, Halesowen, United Kingdom

[21] Appl. No.: 232,262

[22] PCT Filed: Nov. 13, 1992

[86] PCT No.: PCT/GB92/02105

§ 371 Date: May 6, 1994

§ 102(e) Date: May 6, 1994

[87] PCT Pub. No.: WO93/10395

PCT Pub. Date: May 27, 1993

[30] Foreign Application Priority Data

Nov. 16, 1991 [GB] United Kingdom ..... 9124398

[51] Int. Cl.[6] ..... F21V 21/20

[52] U.S. Cl. ..... 362/401; 362/220; 362/285; 362/403; 362/419

[58] Field of Search ..... 362/401, 402, 403, 418, 362/220, 285, 287, 419, 413

[56] References Cited

U.S. PATENT DOCUMENTS

| | | | |
|---|---|---|---|
| 272,169 | 2/1883 | Stieringer | 362/401 |
| 321,887 | 7/1885 | Cross | 362/403 |
| 1,606,870 | 11/1926 | Crowin | 362/401 |
| 1,927,250 | 9/1933 | Wilson | 362/403 |
| 4,463,413 | 7/1984 | Shirley | 362/401 |
| 4,651,263 | 3/1987 | Hancock | 362/402 |
| 4,803,606 | 2/1989 | Rotter | 362/419 |
| 5,023,755 | 6/1991 | Rosenberg | 362/419 |

*Primary Examiner*—Ira S. Lazarus
*Assistant Examiner*—Alan B. Cariaso
*Attorney, Agent, or Firm*—Young & Thompson

[57] ABSTRACT

A lamp stand 1 is provided which has a ground-engaging base 2, a vertical support member 3 carried on the base, a carriage 10 movable along the support member, and an arm 11 on the carriage for attachment of a photographic lamp 9. The carriage 10 is mounted on the support member 3 so as to be slidable along the support member 3 to adjust its vertical position simply by manually applying a lifting force to a portion of the lamp 9 and raising or lowering the lamp to the required height, and so that, when the lamp 9 is subsequently released on reaching of the required height, the carriage 10 is fixedly held in that position on the support member 3 by frictional engagement with the support member. This renders adjustment of the height of the lamp particularly straightforward.

8 Claims, 4 Drawing Sheets

LAMP STANDS

This invention relates to lamp stands and is more particularly, but not exclusively, concerned with photographic lamp stands.

In studio photography, lighting of a subject is very commonly achieved by use of powerful photographic lamps supported by specially adapted stands. The positioning of the lamps and their orientation can be critical to the particular lighting effects to be obtained, and it is therefore important that the lamps should be adjustable in height on their stands. Whilst such height adjustment is generally a feature of such stands, it normally involves some clamping arrangement which must be loosened to permit the lamp to be lowered or raised on the stand and subsequently tightened to lock the lamp in the required position.

It is an object of the invention to provide a lamp stand which is particularly easily adjustable.

According to the present invention there is provided a lamp stand comprising a ground-engaging base a, vertical support member carried on the base, a carriage mounted on the support member so as to be slidable therealong to adjust its vertical position and attachment means on the carriage for attaching a lamp thereto, whereby the vertical position of the carriage is adjustable by application of a lifting force to a portion of the lamp and by raising or lowering of the lamp to a required height, the carriage being frictionally held in position on the support member when the lamp is subsequently released, characterised in that the support member comprises two vertical support surfaces extending parallel to one another on opposite sides of the support member, and that the carriage incorporates braking portions which are forced into engagement with said support surfaces by the weight of the lamp acting on the carriage when the carriage is in a braking position and which are disengaged from said support surfaces when the carriage is moved into a release position by application of said lifting force, and guide portions which engage said support surfaces when the carriage is in the release position to permit sliding of the carriage along the support member during raising or lowering of the lamp.

In order that the invention may be more fully understood, a preferred embodiment of the invention will now be described, by way of example, with reference to the accompanying drawings in which.

Figure 1:
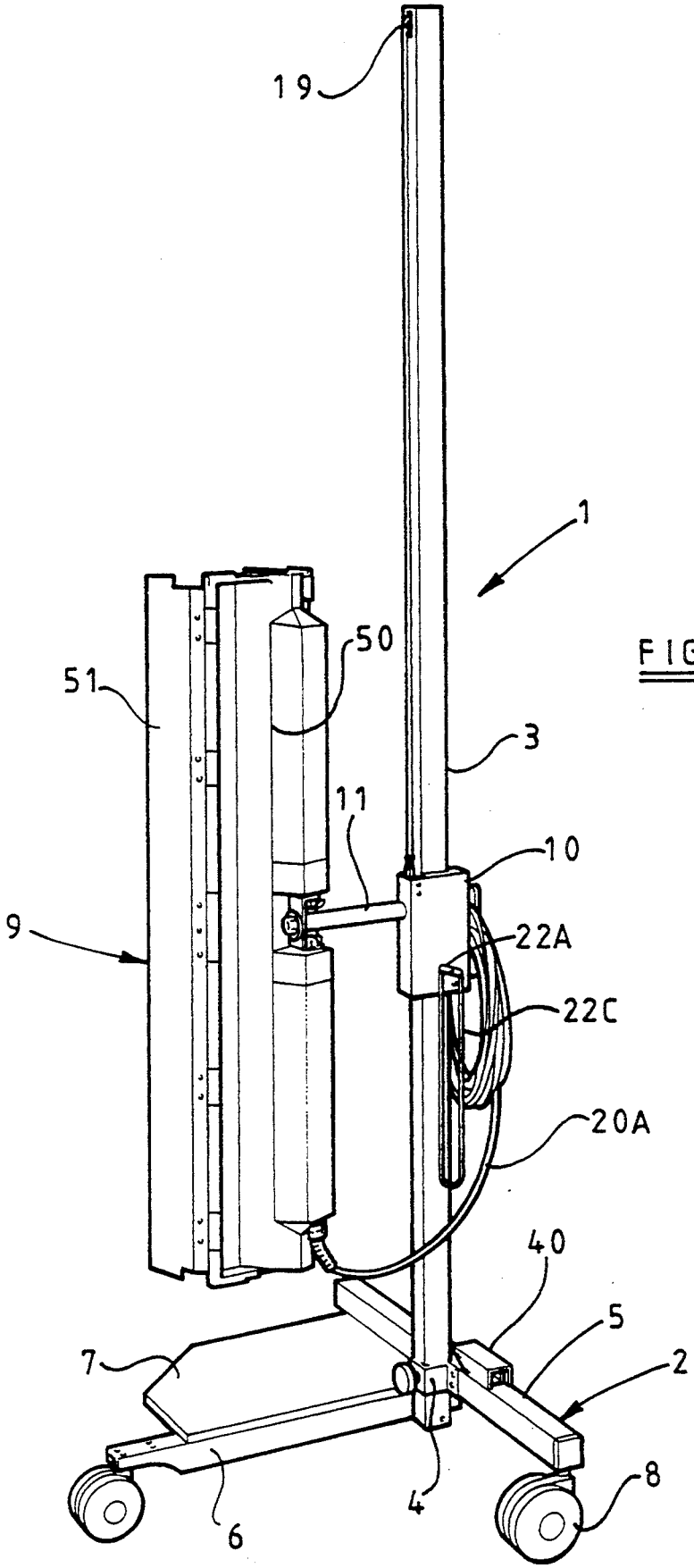
FIG. 1 is a perspective view of the photographic lamp stand.

Referring to FIG. 1, the lamp stand 1 comprises a ground engaging base 2 to which a vertical support member 3 constituted by an aluminium tube is detachably connected by a clamping collar 4. The base 2 comprises two sections 5 and 6 of aluminium tube connected together to form a T-shape and a platform 7. Three castors 8 are mounted at the three extremities of the base 2. The lamp 9 is mounted on the support member 3 by a movable carriage 10 to which the lamp 9 is attached by a tubular steel arm 11, and is adjustable in height by movement of the carriage 10 along the support member 3.

Figure 2:
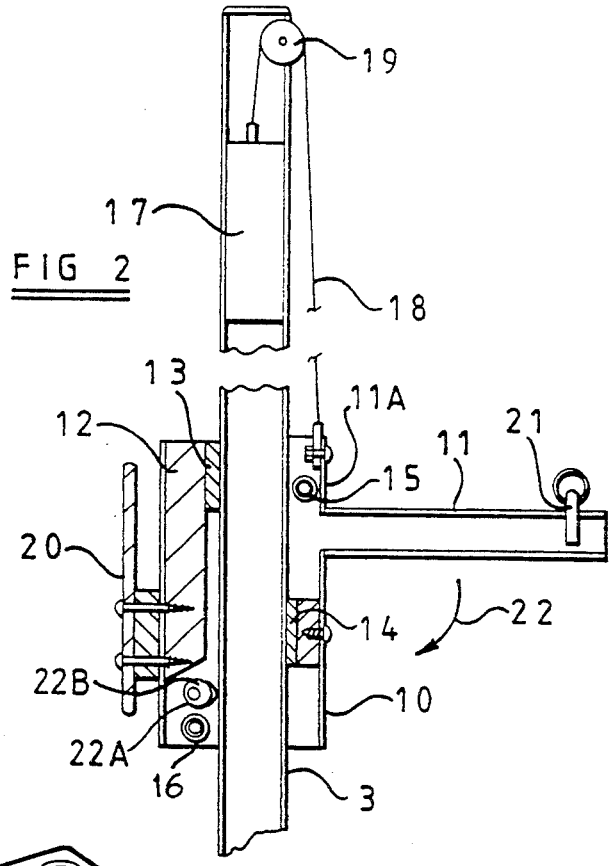
FIGS. 2 and 4 are sectional views through parts of the stand.

Referring to FIG. 2, the carriage 10 has a square-section steel outer casing 11A surrounding the support member 3 and containing a weight 12, two polyurethane brake pads 13 and 14 and two rotatable rollers 15 and 16. In addition a counterbalance weight 17 located in the hollow space within the support member 3 is coupled to the carriage 10 by a wire cable 18 passing over a pulley 19 which projects through a slot at the upper end of the support member 3. A cable hanger 20 is connected to the carriage 10 for supporting the power cable 20A (see FIG. 1) of the lamp.

Figure 3:
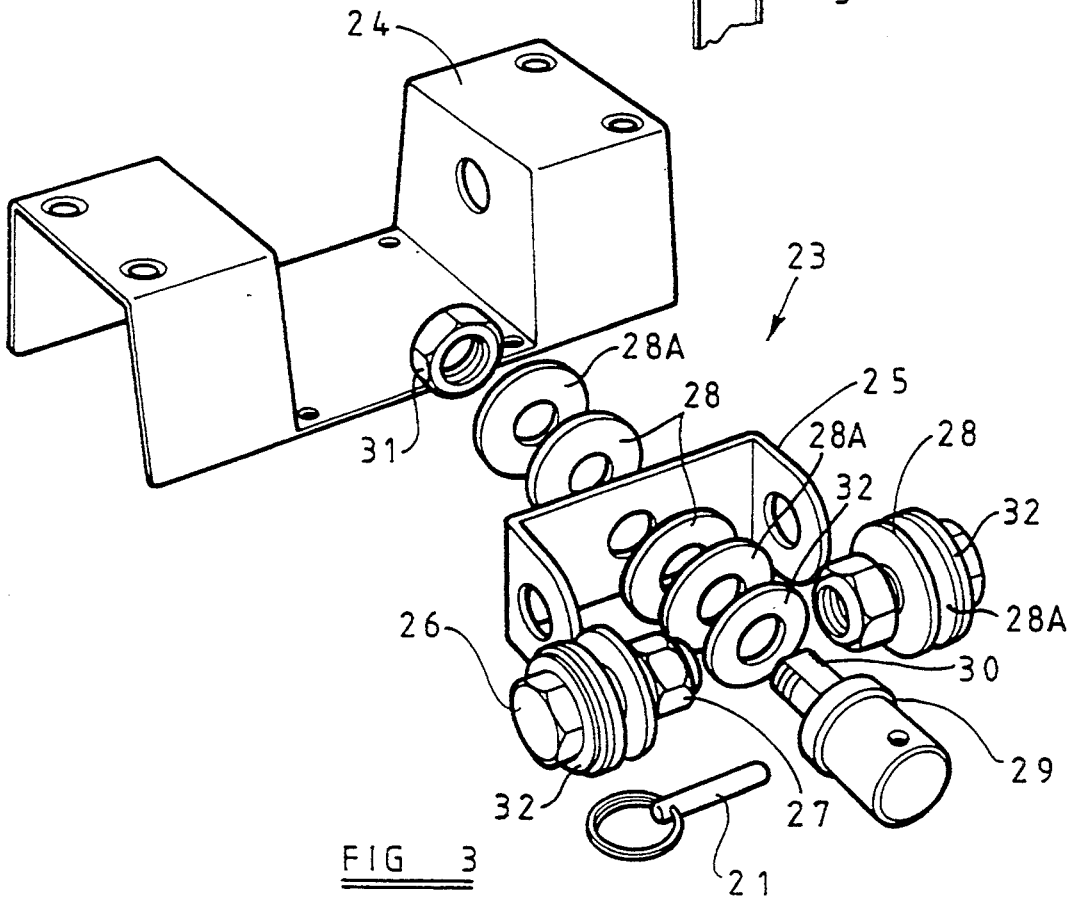
FIG. 3 is an exploded view of an assembly for attaching the lamp to the stand.

When the lamp is attached to the arm 11 by a quick release assembly including a removable steel pin 21, as will be described more fully below with reference to FIG. 3, the carriage 10 is fixedly held in position on the support member 3 by virtue of the fact that the weight of the lamp acts to tend to pivot the carriage 10 about a horizontal axis, as indicated by the arrow 22, so as to force the brake pads 13 and 14 into engagement with opposite side surfaces of the support member 3. In this position the two rollers 15 and 16 are spaced from the side surfaces of the support member 3 by about 1 mm. In addition the carriage 10 is partially supported by the counterbalance weight 17 which is chosen to substantially fully counterbalance the weight of the carriage 10 with the lamp removed.

When it is required to adjust the height of the lamp, it is simply necessary to manually apply a lifting force to the lower part of the lamp so as to release the brake pads 13 and 14 from the support member 3 and engage the rollers 15 and 16 with the support member 3, and to raise or lower the lamp to the required height so that, on subsequent release of the lamp, the carriage 10 will again be held in position by engagement of the brake pads 13 and 14 with the support member 3 under the effect of the weight of the lamp.

If required, a locking mechanism 22A may be provided on the carriage 10 to enable the carriage 10 to be locked in position on the support member 3 so as to prevent accidental release of the carriage, for example by the lamp striking an overhead object as the stand is being moved. The locking mechanism 22A comprises an eccentric cam 22B which is pivotable by an actuating cord 22C (see FIG. 1) to engage the cam 22B with the support member 3 to lock the carriage 10 in position, and which is subsequently pivotable in the opposite direction to release the carriage.

The quick release assembly 23 for connecting the lamp to the arm 11 will now be described with reference to the exploded view shown in FIG. 3. In that figure a mounting part 24, which is normally screwed to the back of the lamp, is connectable to a U-shaped bracket 25 by two nuts and bolts 26, 27 passing through apertures in respective arms of the bracket 25 and the mounting part 24 so that the lamp is pivotal about a vertical axis with respect to the bracket 25. The provision of ptfe washers 28 and steel washers 28A acted upon by disc springs 32 permits ease of pivoting about the vertical axis whilst ensuring that the lamp remains in any required angular position relative to that axis in which it is placed, the friction being adjustable by varying the compression of the disc springs 32 by tightening or loosening of the nuts 27. The bracket 25 is in turn coupled to the arm 11 by a coupling part 29 having a screwthreaded portion 30 which extends through a further aperture in the bracket 25 and to which a nut 31 is secured to permit pivoting of the lamp about the longitudinal axis of the arm 11. Again the provision of ptfe and steel washers 28, 28*a* and a disc spring 32 enables the lamp to be held in any required angular position relative to that axis. The coupling part 29 is releasably held within the end of the tubular arm 11 by the pin 21.

Figure 4:
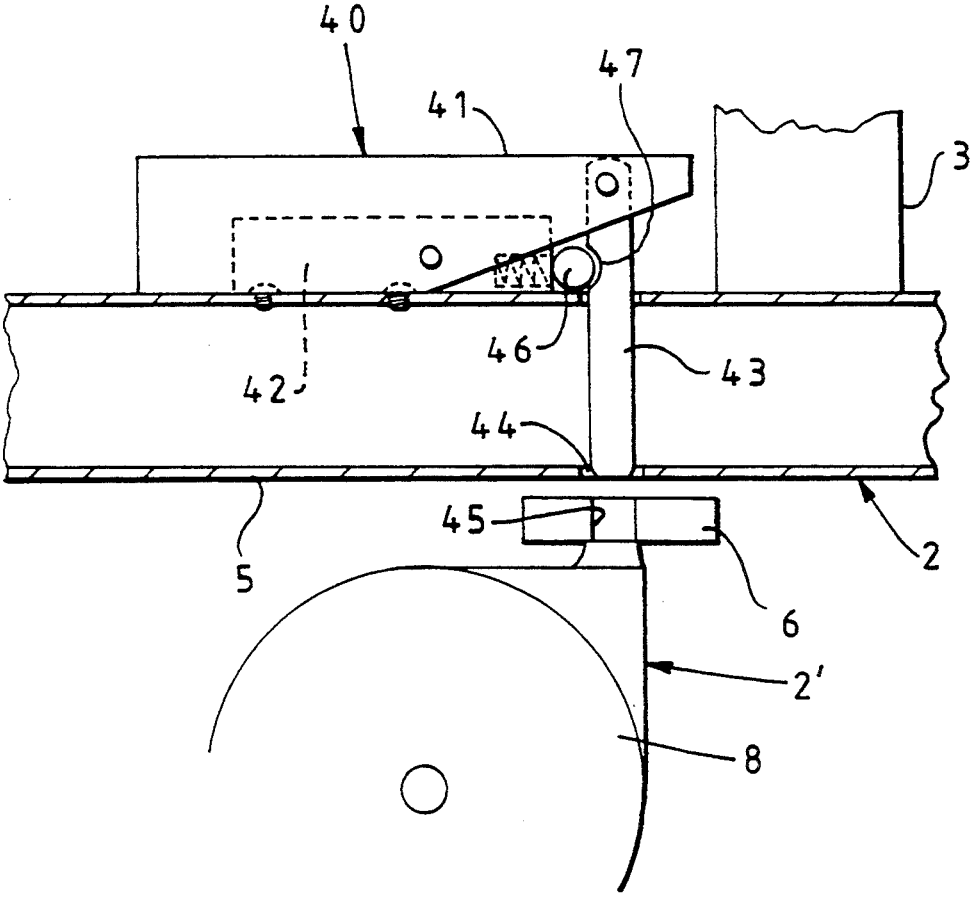
Figure 5:
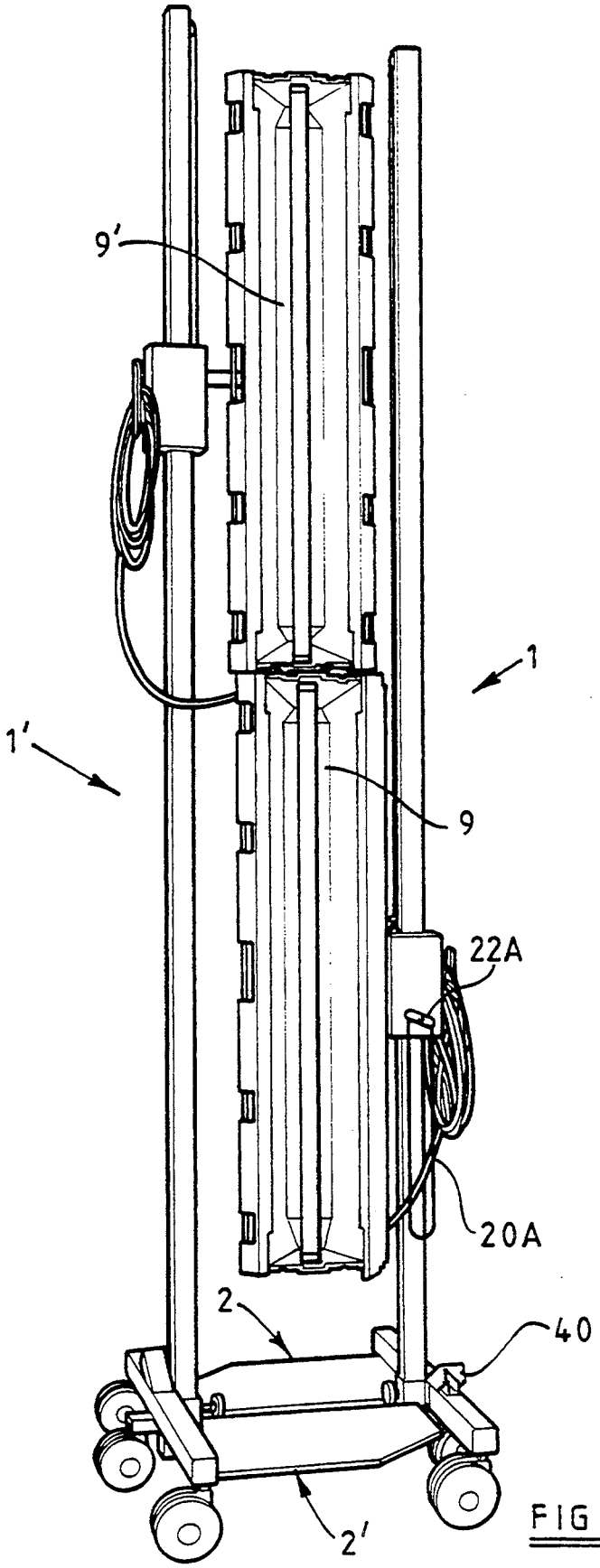
FIG. 5 is a perspective view of two lamp stands connected together.

The form of the base 2 of the stand is such as to permit two stands 1 and 1' to be disposed relative to one another, as shown in FIG. 5, so that a lamp 9' supported by the stand 1' can be positioned immediately above the lamp 9 supported by the other stand 1, as may be required in certain lighting situations. In this position the bases 2, 2' of the two stands are so located that the section 5 of each base overlaps an end portion of the section 6 of the other base, and this permits a latching mechanism 40 on each base to be operated to lock the two bases together, as will be described in more detail with reference to FIG. 4.

FIG. 4 shows the latching mechanism 40 of the base 2 in a position prior to latching engagement with the base 2'. The latching mechanism 40 includes a foot-operated pedal 41 pivotally mounted on a support member 42 screwed to the section 5 and a latching pin 43 pivotally connected to the pedal 41 and extending through apertures 44 in the section 5. The pin 43 is held in this position by a spring-operated roller catch 46 engaging within a notch 47 in the pin 43. The pedal 41 may be pivoted so as to push the latching pin 43 downwardly to engage within an aperture 45 in the section 6 of the other base 2', the catch 46 being released from the notch 47 against spring action during such operation. In this manner the bases 2, 2' are held together by the latching mechanism 40 associated with each base, the latching mechanisms 40 being subsequently releasable simply by reverse pivoting of their pedals 41.

Finally, referring again to FIG. 1, the lamp 9 has an elongate body 50 supporting a strip light and having two hinged doors 51 which, when fully open, fold neatly into the back of the body 50. In addition slots are provided to permit filter screens to be slid into the front of the body 50 if required.

I claim:

1. A lamp stand comprising a ground-engaging base, a vertical elongate support member carried on the base, a carriage surrounding the support member and mounted so as to be slidable therealong to adjust the vertical position of the carriage, and attachment means for attaching a lamp to the carriage, the vertical position of the lamp being adjustable by application of a lifting force to a portion of the lamp so as to pivot the carriage about a horizontal axis from a holding position to a release position and by raising or lowering of the lamp to a required height, wherein the support member comprises two vertical support surfaces extending parallel to one another on opposite sides of the support member, and the carriage incorporates braking portions which are forced into engagement with said support surfaces by the weight of the lamp acting on the carriage when the carriage is in the holding position so as to frictionally hold the carriage in the required vertical position on the support member and which are disengaged from said support surfaces when the carriage is pivoted into the release position by application of said lifting force, and roller means which engage said support surfaces when the carriage is in the release position to permit sliding of the carriage along the support member during raising or lowering of the lamp.

2. A lamp stand according to claim 1, characterised in that the brake portions are offset relative to one another longitudinally of the support member defining higher and lower brake portions, and the attachment means for the lamp is provided on the carriage on the same side of the support member as the lower brake portion so that the weight of the lamp tends to pivot the carriage into the holding position.

3. A lamp stand according to claim 1, characterised in that the roller means includes respective rollers for engaging said support surfaces of the support member when the carriage is in the release position.

4. A lamp stand according to claim 1, characterised in that the carriage is partially supported by counterbalance means comprising a weight connected to an upper portion of the carriage by a cable running over a pulley.

5. A lamp stand according to claim 1, characterised in that locking means are provided for selectively locking the carriage with respect to the support member.

6. A lamp stand according to claim 1, characterised in that the attachment means comprises a transverse arm to which the lamp is releasably attachable by pivot means enabling the lamp to be pivoted about two axes extending perpendicularly to one another.

7. A lamp stand according to claim 1, characterised in that the ground-engaging base has wheels.

8. A lamp stand according to claim 1, characterised in that the ground-engaging base has a latching mechanism permitting the base to be releasably coupled to the base of a further, similar lamp stand.

* * * * *